United States Patent [19]

Werner

[11] 3,977,286

[45] Aug. 31, 1976

[54] CUTTING APPARATUS FOR LARGE-AREA MATERIAL IN SHEET FORM

[75] Inventor: Johannes Werner, In der Stroth, Germany

[73] Assignee: Meteor-Siegen Apparatebau Paul Schmeck GmbH, Frankfurt, Germany

[22] Filed: Apr. 16, 1975

[21] Appl. No.: 568,418

[30] Foreign Application Priority Data

Apr. 24, 1974 Germany ..... 2419689

[52] U.S. Cl. ..... 83/524; 83/203; 83/578; 83/614

[51] Int. Cl.[2] ..... B26D 1/10

[58] Field of Search ..... 83/524, 578, 614, 203, 83/205; 355/13, 28, 29

[56] References Cited

UNITED STATES PATENTS

| | | | |
|---|---|---|---|
| 1,920,591 | 8/1933 | Pesci | 83/578 X |
| 2,344,372 | 3/1944 | Sikstrom | 83/614 |
| 3,277,760 | 10/1966 | Keene et al. | 83/614 X |
| 3,633,447 | 1/1972 | Casida et al. | 83/484 X |
| 3,748,939 | 7/1973 | Feinstein | 83/614 X |

*Primary Examiner*—J. M. Meister

*Attorney, Agent, or Firm*—Christie, Parker & Hale

[57] ABSTRACT

An apparatus for cutting sheet material with large surface area, particularly photo-printing paper in strips, has a mobile head which is drawn along a guide path in the cutting direction over a processing table for the sheet by means of a traction device driven by an electric motor. The cutting head consists of a flat deflector located slightly above the processing table, a cutter extending into a groove which forms the guide path in the processing table, and a coupling element for connection to the traction device. Significantly, the deflector simultaneously deflects a further sheet of material while cutting the desired sheet of material.

12 Claims, 4 Drawing Figures

CUTTING APPARATUS FOR LARGE-AREA MATERIAL IN SHEET FORM

BACKGROUND OF THE INVENTION

This invention relates to the field of cutting apparatuses for large-area material in sheet form, and particularly for photo-printing paper in strips. A cutting apparatus for exposed and developed photo-printing paper which cuts the edges of a sheet of paper laid on a processing table is available. The cutter head of this apparatus consists of a roller cutter mounted in a holding device which moves along a guide bar and interacts with a stationary linear cutter to produce a cut. The holding device is fastened to a chain which runs over reversing pulleys on the side plates of the cutting table. A pinion of an electric motor can be connected to the two sides of the chain so that cuts are alternatively made from the two sides of the cutting table in succession.

This invention is related to this apparatus for exposed photo-printing paper, but is primarily intended to solve a different cutting problem, the problem of cutting unexposed photo-printing paper. In photo-printing machines in which the unexposed photo-printing paper is drawn off a delivery spool and cut off in accordance with the length of the original, the cut must be made when the rear of the original has reached the processing table, and a sufficient quantity of photo-printing paper, usually guided from a delivery spool mounted underneath the entry table around the rounded front edge of the table, has been drawn off.

Unless the photo-printing machine is fitted with an automatic cutting device, which makes the cut automatically in accordance with the scanned end of the original, the cutting has to be done by hand. For this purpose systems are known in which a thin wire is placed in a groove located approximately along the top line of the rounded front edge of the processing table. The wire is fixed on one side of the table while being attached to a spring on the other side. The wire runs through a ring with which it can be pulled out of the groove against the force of the spring. In rest this ring occupies a position adjacent to the photo-printing paper being guided over the front edge of the feed table. To cut off the paper the ring is gripped and drawn across the feed table, so that the wire emerges from the groove and cuts through the photo-printing paper stretched across the table.

A cutting apparatus of this kind cannot be mechanized, and its manual operation has a number of drawbacks, of which the most serious is slowness. The slower the ring is moved across the table, the more oblique will be the cut made in the photo-printing paper, which, of course, is moving while being cut.

A cutting apparatus operating to some extent in the reverse manner also has been designed. This apparatus has a wire stretched above the processing table, and a groove provided in the table. The wire is drawn downwards into the groove by a motor, thereby cutting the paper. This system however, suffers from the serious drawback that if the cutting apparatus is actuated too soon the photo-printing paper will be cut too short. In addition the original, which is situated above the photo-printing paper and therefore between the processing table and the cutting wire, also will be cut and irreparably damaged.

SUMMARY OF THE INVENTION

The object of this invention is to provide a cutting apparatus for large-area material in sheet form where the cutter exactly cuts off only the correct amount of material. The cutting apparatus which performs this function has a cutter head which moves along a guide path over the feed table for the sheet material. The cutter head is pulled by a guide piece which is part of a traction device driven by an electric motor. The cutter head comprises a deflector positioned at a selected distance, preferably about equal to the thickness of the sheet material, from the surface of the feed table, a cutter which extends into a groove which forms a guide path and is located in the feed table, and a coupling element which is attached to the traction device. The deflector has a portion facing away from the table surface the outer edge of which extends obliquely from the table surface. The deflector thereby allows the sheet material to pass in between the deflector and table surface for cutting while deflecting an adjacent sheet of material away from the cutter.

DESCRIPTION OF THE INVENTION

Figure 2:
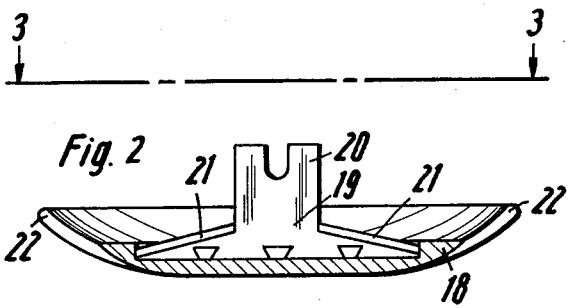
FIG. 2 is an enlarged view of the cutter head of FIG. 4.
Figure 3:
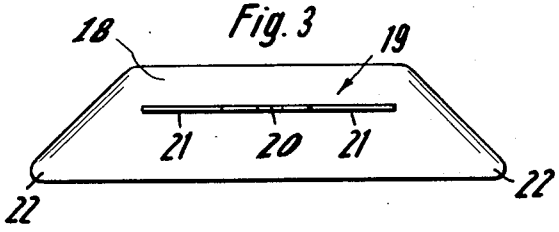
FIG. 3 shows a full rear view of the cutter head in the direction shown by line 3—3 of FIG. 2.
Figure 1:
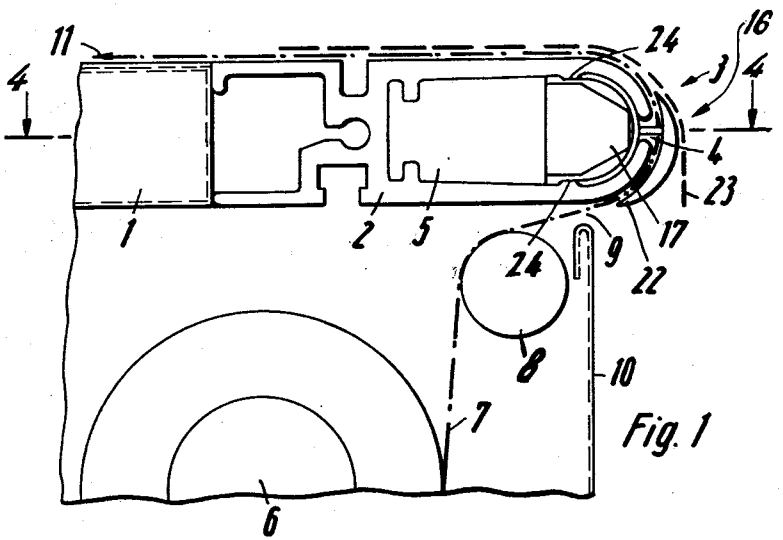
FIG. 1 depicts a lateral fragmentary schematic view of the feed table zone of a photo-printing machine with the side cover at the front portion of the feed table removed, and with the cutting apparatus positioned away from the side with the cover removed.
Figure 4:
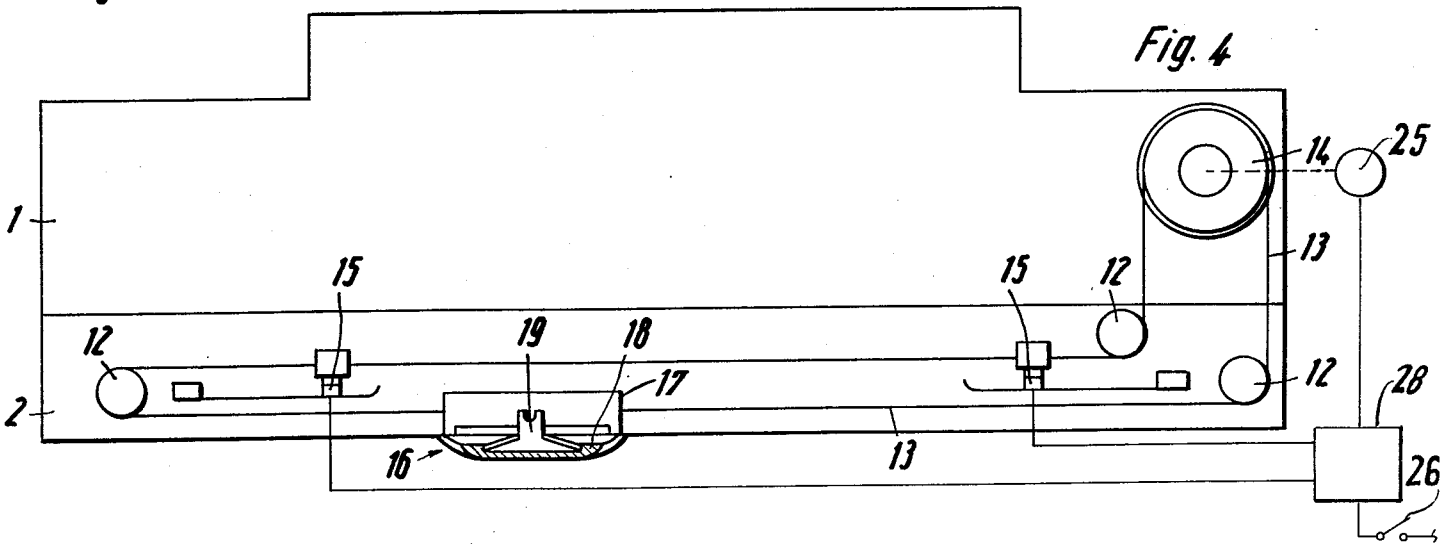
FIG. 4 shows a largely schematic cross section along the line 2—2 of FIG. 1 looking from the right hand side of FIG. 1.

FIGS. 1–4 show an embodiment of this invention where the large-area material in sheet form is photo-printing paper being fed to a photo-printing machine. As shown in FIG. 1, feed table 1 of the photo-printing machine, which is only partly shown, is provided in the front with an extruded profile 2, preferably of aluminum, extending over its entire width. The feed table and extruded profile have substantial width, as shown in FIG. 4, and therefore extend into the paper of FIG. 1. As shown in FIG. 1 the right side of profile part 2 forms front edge 3 of feed table 1, and is rounded semicircularly. Groove 4 provided along the apex of rounded front edge 3 passes through the entire thickness of the wall of profiled part 2, thus forming a slit leading into chamber 5 of the profiled part, and provides the guide path for cutter head 16. Groove 4 is transverse to the direction of movement of photo-printing paper 7.

Underneath the feed table is delivery spool 6 for photo-printing paper 7, which passes around the front edge of the feed table, on the upper side thereof, via deflecting roller 8, and through slit 9 formed between the lower side of the feed table and front covering 10 of the photo-printing machine when the latter is in operation and photo-printing paper 7 is being drawn off spool 6. The direction of movement of photo-printing paper 7 is indicated by the tip of arrow 11 in FIG. 1.

Chamber 5 of profiled part 2 contains three deflecting rollers 12, which rotate about their vertical axes and are driven by drive belt 13. As shown in FIG. 4, this belt is in the form of a loop and extends as far as the actual photo-printing machine, and continues over toothed gear 14 which is driven bi-directionally by electric motor 25 which is actuated by actuating switch 26. Limit switches 15 are located on the left and right sides of feed table 1 inside chamber 5 of extruded profile 2. These switches are actuated by the cutter head, which is part of cutting apparatus 16, when the cutter head, which is driven by toothed gear 14 and drive belt 13, reaches one of the two lateral terminal positions by limit switches 15, as shown in FIG. 4.

The motor 25 is controlled by a reversible motor control unit 28. The motor control 28 has inputs connected to limit switches 15 and to the start switch 26. If the cutter head is positioned in contact with the left limit switch 15, a motor control 28 will cause the cutter head to be driven to the right responsive to actuation of the start switch 26. When the cutter head reaches the right and actuates the right hand limit switch 15, motor control 28 responds by removing the power drive to motor 25 and changes state so that upon subsequent actuation of start switch 26, the motor will drive in the reverse direction to return the cutter head to the left hand limit switch 15. When the left hand switch is actuated, motor control 28 responds by removing the power drive to motor 25 and changes state so that upon subsequent actuation of start switch 26, the motor will drive in the reverse direction towards the right hand limit switch 15.

Also as shown in FIG. 4, cutter head 16 consists of deflector 18, cutter 19, and coupling element 20. The free ends of drive belt 13 are attached to ends of guide piece 17, which slides inside chamber 5 between inner projections 24 of extruded profile 2. The cutter head is attached to the guide piece by means of coupling element 20 which is in the form of a tongue-shaped extension of cutter 19. The coupling element is set in a slit (not shown) in guide piece 17 and is affixed to the guide piece by a screw (not shown). One part of extruder profile 2 has a recess in the bottom so that the coupling element can be attached to the guide piece.

Cutter 19 is inserted into deflector 18 in a manner which is shown most clearly in FIG. 2. Cutter 19 has two oblique cutting blades 21 ground onto it, which alternatively cut paper as the cutter head moves back and forth in guide path groove 4. The cutting blades of cutter 19 are located primarily inside groove 4 in the front edge 3 of the feed table.

As shown in FIG. 3, deflector 18 is trapezoidal in horizontal projection, when looked at from the direction of the left side of FIG. 1. Cutter 19 is mounted off center in relation to the parallel sides of deflector 18 so that the deflector extends farther over the lower half of front edge 3 than over its upper half, as depicted in FIG. 1. The cross section of the deflector corresponds to the curvature of the front edge of the feed table and is rounded on all corners and edges. The deflector sits slightly away from the front edge of the feed table at a distance corresponding to and about equal to the thickness of the photo-printing paper.

Because of this construction and arrangement, lateral triangular projections 22 of the deflector are situated relatively far below and far back from the cutting plane, i.e., the plane of cutter 19 in groove 4. Therefore, if the cutting apparatus is actuated too soon there is no danger that cutter 19 will act on original 23. This construction of the cutter head, as best seen in FIGS. 1 and 2, provides a deflector with an outer side portion which faces away from the table surface and which slopes obliquely to the table surface.

When the machine of FIGS. 1–4 is operated, a photoprint of the original is made onto photo-printing paper. Also, the electric motor, upon being activated by the start switch, drives the drive belt, which pulls the cutter head along the guide path across the face of the feed table. The cutter cuts the photo-printing paper which is moving transverse to the direction of movement of the cutter head. When the cutter head contacts one of the two limit switches, the limit switch acts to stop the motor and at the same time preselect the opposite direction of rotation for the motor the next time it is switched on by the start switch.

When this invention is being used to cut sheet material, the flat deflector, of which all the edges and corners are advantageously rounded, feeds the cutter with only the actual sheet material to be cut off, because of its guiding action. The deflector reliably diverts any loose objects such as other sheet material away from the cutter, thereby protecting such objects from damage by the cutter. The traction device, which is mounted underneath the groove and which is driven by an electric motor, causes this new type of cutter head to move at a high speed compared to the speed of the photo-processing table, thereby insuring a comparatively straight cutting line, even when sheet material is moving perpendicularly to the cut.

If the direction of movement of the sheet material is shifted during its passage over the processing table, it is preferred, as shown in FIG. 1, that the cutting apparatus be mounted in the area of this shift of direction and that the deflector be curved to correspond to the surface curvature provided in the processing table for the purpose of shifting the direction of the sheet material. This arrangement and construction is particularly important when the curved surface of the processing table consists of the rounded front edge of a feed table of a photo-printing machine as in FIGS. 1–4, where the front edge of the feed table shifts the direction of the photo-printing paper drawn off a delivery spool underneath the feed table. In the case of a photo-printing machine, it also is preferred that a cross-section through the deflector taken transverse to the direction of movement of the cutter head be trapezoidal in shape, the parallel sides of the trapezoid being parallel to the cutter, and the longer of the two parallel sides of the trapezoid facing towards the lower side of the feed table.

When the feed table has a rounded front edge, as in FIG. 1, it also is preferred that the groove be located in the apex of the rounded front edge of the feed table, and that the deflector cover a larger part of the lower half of the front edge than its upper half. This makes it far more certain that the deflector will hold down the photo-printing paper to be cut off, and at the same time deflect the original paper when the original paper is located above the photo-printing paper. This system offers the additional advantage that only a very small residual width of photo-printing paper is left uncovered, to be pre-exposed, between the container enclosing the delivery spool underneath the feed table on the one hand and the front edge of said feed table on the other.

As shown in FIGS. 1 and 4, the traction device preferably consists of a drive belt which is guided over reversing rollers, and which is driven bi-directionally by an electric motor. To achieve the reversal of direction of the traction device, limit switches 15 provided in the processing table and actuated by the cutter head are designed in conjunction with motor control 28 to switch off the motor and at the same time pre-select the opposite direction of rotation for the motor the next time it is switched on by start switch 21. Switch 26 may be activated manually or by a scanning device which detects the end of the original.

When the cutting apparatus of this invention is mounted on the feed table of a photo-printing machine, it is preferred that the system be arranged in such a way that the front edge consists of part of an extruded hollow profile which contains the traction device, the deflecting rollers, and the limit switches. If this arrangement is used, then the only part of the cutting apparatus which is visible from the outside is the outer surface of the deflector.

What I claim is:

1. An improved cutting apparatus, comprising:

a. a processing table for receiving sheet material, b. a groove in the processing table providing a guide path for a cutting apparatus, c. a traction device for driving a cutting apparatus bi-directionally along the groove, and d. a cutter head coupled to the traction device and comprising a cutter extending into the groove, a deflector positioned a selected distance from the processing table to permit such sheet of material to extend between the table and the deflector to the cutter, the deflector having a portion facing away from the table with an outer edge which portion extends obliquely towards the table for deflecting a further sheet of material from the cutter while such sheet of material is cut.

2. Cutting apparatus as claimed in claim 1 wherein said table has a surface and said traction device is disposed below the table surface in such groove and is connected to the cutter.

3. Cutting apparatus as claimed in claim 1 wherein the traction device comprises a drive belt and deflecting rollers over which the drive belt is guided, and comprising an electric motor for driving the deflecting rollers bi-directionally during cutting operations.

4. Cutting apparatus as claimed in claim 3 comprising means for controlling the stopping and direction of the drive of the motor and comprising at least two limit switches in the processing table each activated by the cutter head to switch off the motor after it has been switched on by a starting switch and at the same time for preselecting the opposite direction of rotation for the electric motor for the next time it is switched on.

5. A machine for photo-printing from an original medium onto an adjacent photo-printing material including an improved cutting apparatus, the machine comprising:

a. a feed table having a surface for receiving photo-printing material, b. a groove in the feed table and comprising a guide path for a cutting apparatus, c. a traction device in the groove for driving a cutting apparatus bi-directionally along the groove, and d. a cutter head comprising a cutter extending into the groove, a deflector positioned a selected distance from the feed table to permit such photo-printing material to extend between the table and the deflector to the cutter, the deflector having a portion facing away from such table with an outer edge which portion extends obliquely towards the table surface for deflecting the original medium from the cutter, and means for coupling the cutter to the traction device.

6. A machine as claimed in claim 5 wherein said traction device is disposed below the table surface in such groove and is connected to the cutter.

7. A machine as claimed in claim 5 wherein the table has a curved surface facing the deflector and the portion of the deflector facing the table surface is curved corresponding to the surface curvature of the table surface.

8. A machine as claimed in claim 5 wherein a cross-section through the deflector transverse to the direction of motion of the cutting head is trapezoidal in shape with its parallel sides parallel to the cutter and its larger parallel side located lower on the surface of the feed table than the shorter parallel side.

9. A machine as claimed in claim 7 wherein the groove is located at the apex of the curved surface of the table and the deflector covers a larger portion of the curved surface located on one side of the groove than on the other side of the groove.

10. A machine as claimed in claim 5 wherein the traction device comprises a drive belt, deflecting rollers over which the drive belt is guided, and an electric motor for driving the deflecting rollers bi-directionally during cutting operations.

11. A machine as claimed in claim 10 comprising means for controlling the stopping and direction of drive of the motor and comprising at least two limit switches in the machine each activated by the cutter head to switch off the motor after it has been switched on by a starting switch and at the same time for preselecting the opposite direction of rotation for the electric motor for the next time it is switched on.

12. A machine as claimed in claim 7 wherein the curved surface of the table comprises a front edge of the feed table and is comprised of a portion of an extruded hollow part in which is mounted the traction device.

* * * * *